US008690280B2

(12) United States Patent
Nakano et al.

(10) Patent No.: US 8,690,280 B2
(45) **Date of Patent: *Apr. 8, 2014**

(54) PRINTING APPARATUS, PRINTING MATERIAL CARTRIDGE, PRINTING MATERIAL CONTAINER ADAPTER, CARTRIDGE SET, AND ADAPTER SET

(75) Inventors: Shuichi Nakano, Shiojiri (JP); Yasuhiko Kosugi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

This patent is subject to a terminal disclaimer.

(21) Appl. No.: 13/224,234

(22) Filed: Sep. 1, 2011

(65) Prior Publication Data

US 2012/0056921 A1 Mar. 8, 2012

(30) Foreign Application Priority Data

Sep. 3, 2010 (JP) ..... 2010-197312

(51) Int. Cl.
*B41J 29/393* (2006.01)

(52) U.S. Cl.
USPC ..... 347/10; 347/50; 347/86

(58) Field of Classification Search
USPC ..... 347/19, 50, 86
See application file for complete search history.

(56) References Cited

U.S. PATENT DOCUMENTS

| | | | | |
|---|---|---|---|---|
| 4,709,246 | A * | 11/1987 | Piatt et al. | 347/40 |
| 6,825,675 | B1 | 11/2004 | Robbins | |
| 6,923,531 | B2 * | 8/2005 | Saruta | 347/86 |
| 2002/0112878 | A1 | 8/2002 | Ishizawa et al. | |
| 2004/0027400 | A1 | 2/2004 | Ryu et al. | |
| 2004/0183848 | A1 * | 9/2004 | Hasseler | 347/19 |
| 2007/0092270 | A1 | 4/2007 | Inukai | |
| 2009/0051746 | A1 * | 2/2009 | Asauchi | 347/86 |
| 2009/0058944 | A1 * | 3/2009 | Asauchi | 347/50 |
| 2009/0237439 | A1 | 9/2009 | Ishizawa et al. | |
| 2009/0262161 | A1 | 10/2009 | Nishihara | |
| 2009/0289977 | A1 | 11/2009 | Asauchi | |
| 2010/0007702 | A1 | 1/2010 | Kosugi | |
| 2010/0289847 | A1 * | 11/2010 | Ishizawa et al. | 347/19 |
| 2013/0027483 | A1 * | 1/2013 | Asauchi | 347/86 |

FOREIGN PATENT DOCUMENTS

| | | | |
|---|---|---|---|
| AU | 1 445 109 | A1 | 8/2004 |
| JP | 03-284953 | A | 12/1991 |
| JP | 06-155758 | A | 6/1994 |
| JP | 06-262771 | A | 9/1994 |

(Continued)

OTHER PUBLICATIONS

Extended European Search Report of Corresponding EP Application No. 11179590.2, dated Feb. 8, 2013. 9 pages.

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A printing apparatus includes: a holder in which a printing material cartridge set is mounted; and a mounting detection circuit for detecting mounted states of printing material cartridges in the holder. Each of the N printing material cartridges includes a storage device for storing information regarding a printing material which is contained, an electric device for mounting detection, a terminal for the storage device, and a terminal for the electric device. The electric devices of the N printing material cartridges are configured so that a detection voltage becomes equal to or greater than a threshold voltage set in advance when the N printing material cartridges are all mounted in the holder.

3 Claims, 15 Drawing Sheets

(56) References Cited

FOREIGN PATENT DOCUMENTS

| | | | |
|---|---|---|---|
| JP | 2002-198627 | A | 7/2002 |
| JP | 2002-273900 | A | 9/2002 |
| JP | 2003-300333 | A | 10/2003 |
| JP | 2005-119228 | A | 5/2005 |
| JP | 2005-326779 | A | 11/2005 |
| JP | 2007-121551 | A | 5/2007 |
| JP | 2007-168078 | A | 7/2007 |
| JP | 2009-241591 | A | 10/2009 |
| JP | 2009-274438 | A | 11/2009 |

* cited by examiner $$V_{DET}=VHV\frac{R}{R+R_c}$$

$$R_c=R\frac{1}{\sum_{j=1}^{N}\frac{1}{2^j}}$$

PRINTING APPARATUS, PRINTING MATERIAL CARTRIDGE, PRINTING MATERIAL CONTAINER ADAPTER, CARTRIDGE SET, AND ADAPTER SET

BACKGROUND

1. Technical Field

The present invention relates to a printing apparatus, a printing material cartridge used in the printing apparatus, and an adapter for a cartridge.

2. Related Art

Recently, as a printing material cartridge, a cartridge in which a storage device that stores information regarding a printing material (for example, a remaining ink amount) is mounted has been used. In addition, a technique for performing mounting detection on a printing material cartridge has been used. For example, in JP-A-2005-119228, a CPU of a printing apparatus detects whether or not an ink cartridge is mounted by communicating with a storage device of the ink cartridge.

However, in the technique of JP-A-2005-119228, when a user is to perform mounting detection while performing an operation of replacing the ink cartridge, there is a need of detaching the ink cartridge while the ink cartridge is electrically connected to the storage device of the cartridge. In this case, since hot swapping of the storage device is performed, a semiconductor element in the storage device is stressed by the hot swapping, and thus there is a possibility of a bit error occurring. On the other hand, when the CPU is caused not to access the storage device of the cartridge during the operation of replacing the ink cartridge in order to prevent such a bit error, there are problems in that which cartridge is not mounted cannot be displayed on a display panel or the like of the printing apparatus to notify a user during the replacing operation and thus a convenience of the user is significantly degraded.

In addition, as a technique of mounting detection of an ink cartridge, a technique described in JP-A-3-284953 is also known. In the technique of JP-A-3-284953, a mounting detection circuit of a printing apparatus determines whether or not an ink cartridge is mounted by detecting a voltage which is changed according to an ink resistance value in the ink cartridge. However, in this technique, there is a problem in that in order to detect whether or not individual cartridges from among a plurality of ink cartridges are mounted, wiring lines for the mounting detection have to be individually installed between the respective cartridges and mounting detection circuits of the printing apparatus.

In addition, the above-described problem is not limited to ink cartridges and the same problem occurs in a printing material cartridge in which a different kind of printing material (for example, toner) is accommodated.

SUMMARY

An advantage of some aspects of the invention is to provide a technique capable of performing mounting detection of a printing material cartridge by a different means from that according to a related art.

The invention can be realized as the following embodiments or applications.

Application 1

According to an aspect of the invention, there is provided a printing apparatus including: a holder in which a cartridge set is mounted, the cartridge set including N (N is an integer equal to or greater than 2) printing material cartridges which can be independently mounted; and a mounting detection circuit for detecting mounted states of the printing material cartridges in the holder, wherein each of the N printing material cartridges includes a storage device for storing information regarding a printing material which is contained, an electric device for mounting detection which is connected in parallel with the mounting detection circuit, a terminal for the storage device, and a terminal for the electric device, and the electric devices of the N printing material cartridges are configured so that a detection voltage detected by the mounting detection circuit becomes equal to or greater than a threshold voltage set in advance when the N printing material cartridges are all mounted in the holder.

According to the printing apparatus, the detection voltage is determined depending on the mounted state of the electric device for mounting detection which is separately provided from the storage device, and the detection voltage becomes equal to or greater than the threshold voltage set in advance when the N printing material cartridges are all mounted in the holder, so that it is possible to determine whether or not the printing material cartridges are properly mounted in the holder. In addition, during the mounting detection of the printing material cartridges, there is no need for concern about a bit error due to hot swapping of the storage device.

Application 2

In the printing apparatus according to Application 1, the electric devices of the N printing material cartridges may be configured so that the detection voltage has a voltage value capable of uniquely identifying $2^N$ kinds of mounted states regarding the N printing material cartridges, and the mounting detection circuit may determine the mounted states of the printing material cartridges in the holder on the basis of the detection voltage.

In this configuration, the detection voltage has a voltage value that is determined depending on the $2^N$ kinds of mounted states and can be uniquely identified, so that it is possible to determine which of the $2^N$ kinds of mounted states is the mounted state of the printing material cartridge in the holder, using the detection voltage.

Application 3

In the printing apparatus according to Application 2, the electric device of the n-th (n=1 to N) printing material cartridge from among the N printing material cartridges may be a resistive element having a resistance value in a range of $2^n R(1\pm\epsilon)$ where R is a constant value and an allowable error $\epsilon$ is $1/\{4(2^{N-1}-1)\}$.

In this configuration, even when there is an error in the individual resistance value in an allowable range, it is possible to identify the $2^N$ kinds of mounted state using the detection voltage.

Application 4

In the printing apparatus according to any one of Applications 1 to 3, to the terminals for the electric devices of the N printing material cartridges, a voltage higher than a voltage applied to the terminals for the storage devices may be supplied from the mounting detection circuit, each of the N printing material cartridges may further include a terminal for overvoltage detection provided in the vicinity of the terminal for the electric device, and the mounting detection circuit may stop supplying the high voltage to the electric device when an overvoltage is detected via the terminal for overvoltage detection.

In this configuration, when an unintended short circuit occurs due to foreign matter such as ink or dirt between the terminal for the electric device and the terminal for overvoltage detection, this can be immediately detected using the overvoltage, so that it is possible to reduce a possibility of a high voltage for mounting detection being applied to another circuit and damaging the circuit due to the unintended short circuit.

In addition, the invention can be realized in various forms, and for example, can be realized in the forms of a printing material cartridge, a printing material cartridge set including a plurality of kinds of printing material cartridges, a cartridge adapter, a cartridge adapter set including a plurality of kinds of cartridge adapters, a printing apparatus, and a mounting detection method of a printing material cartridge, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Outer Appearance Configuration of Printing Apparatus and Ink Cartridge

Figure 1:
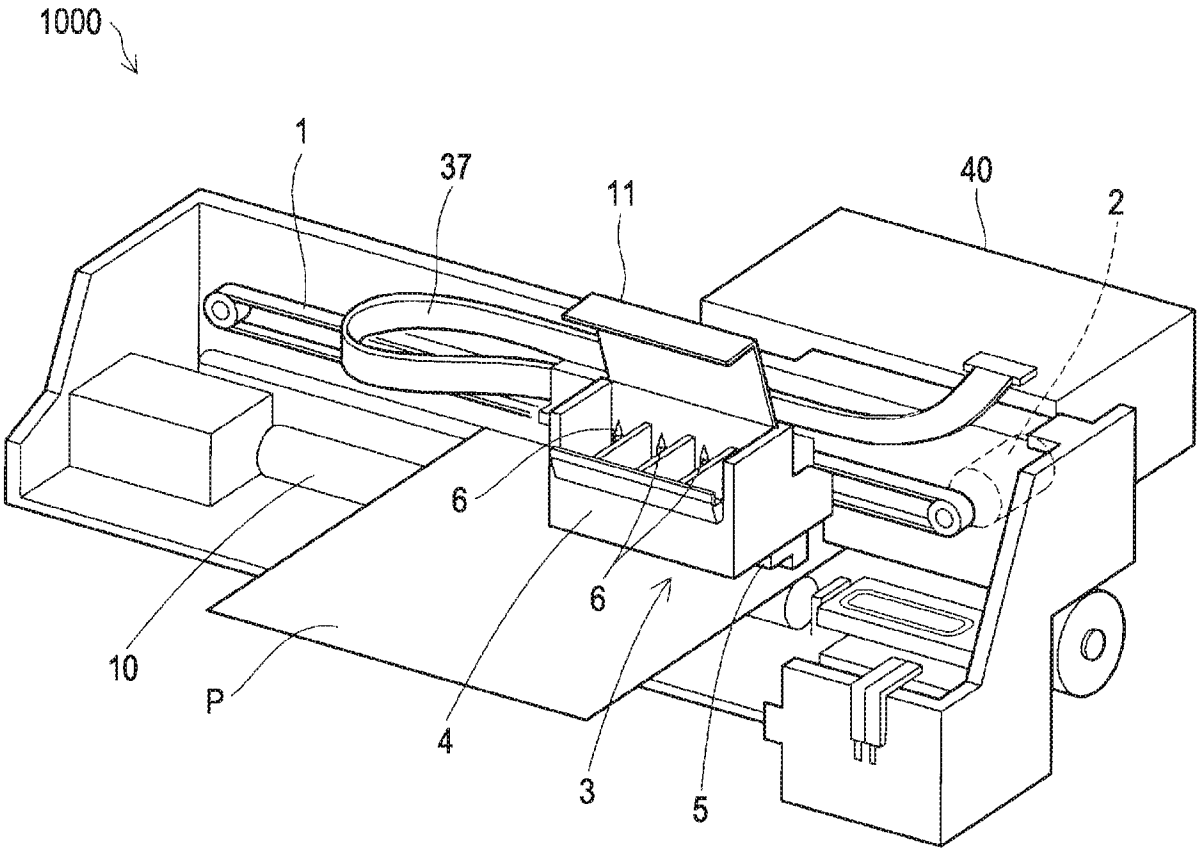
FIG. 1 is a perspective view showing the configuration of a printing apparatus according to an embodiment of the invention.

FIG. 1 is a perspective view showing the configuration of a printing apparatus according to an embodiment of the invention. The printing apparatus 1000 includes a sub-scanning feed mechanism, a main scanning feed mechanism, and a head driving mechanism. The sub-scanning feed mechanism transports a printing sheet P in a sub-scanning direction using a paper feed roller 10 using a paper feed motor (not shown) as a drive power. The main scanning feed mechanism reciprocates a carriage 3 connected to a drive belt in a main scanning direction using a drive power of a carriage motor 2. The head driving mechanism drives a printing head 5 provided in the carriage 3 to perform ink discharge and dot formation. The printing apparatus 1000 further includes a main control circuit 40 that controls the above-mentioned mechanisms. The main control circuit 40 is connected to the carriage 3 via a flexible cable 37.

The carriage 3 includes a holder 4, the printing head 5, and a carriage circuit (described later). The holder 4 is configured so that a plurality of ink cartridges can be mounted therein, and is disposed at the upper surface of the printing head 5. In the example shown in FIG. 1, four ink cartridges can be independently mounted in the holder 4, and for example, black, yellow, magenta, and cyan, that is, four kinds of ink cartridges are mounted, one for each color. In addition, in the holder 4, a plurality kinds of arbitrary ink cartridges may be mounted. A cover 11 is mounted to the holder 4 so as to be opened or closed. At the upper portion of the printing head 5, an ink supply needle 6 is disposed for supplying ink to the printing head from the ink cartridge.

Figure 2A:
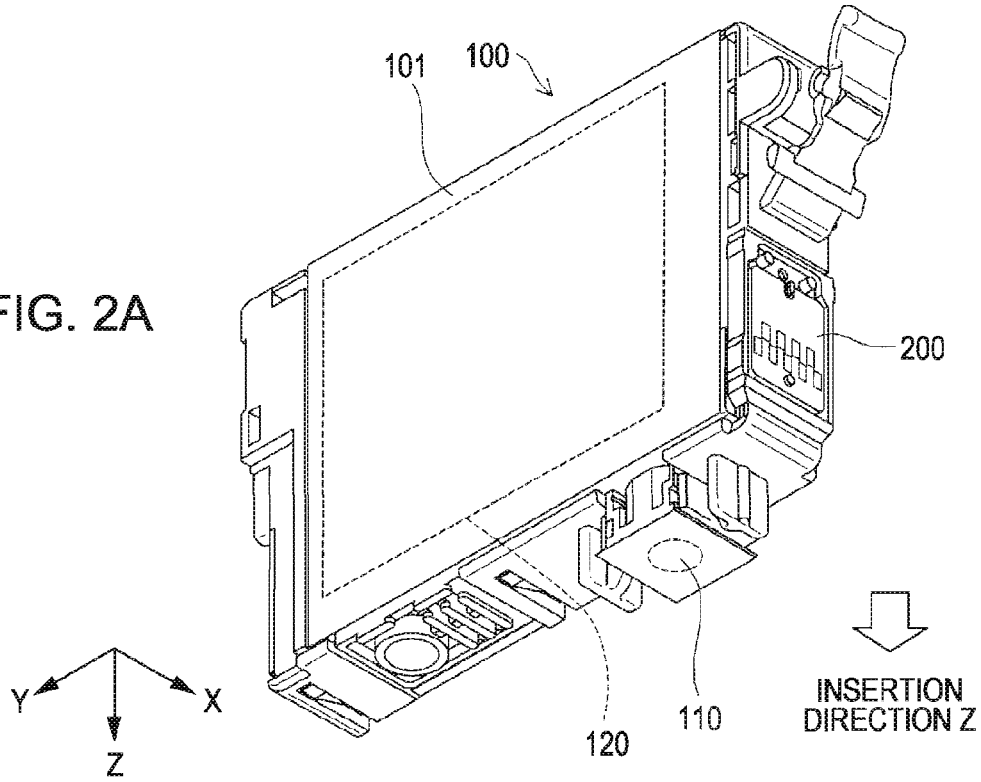
FIGS. 2A and 2B are perspective views showing the configuration of an ink cartridge related to the embodiment.
Figure 2B:
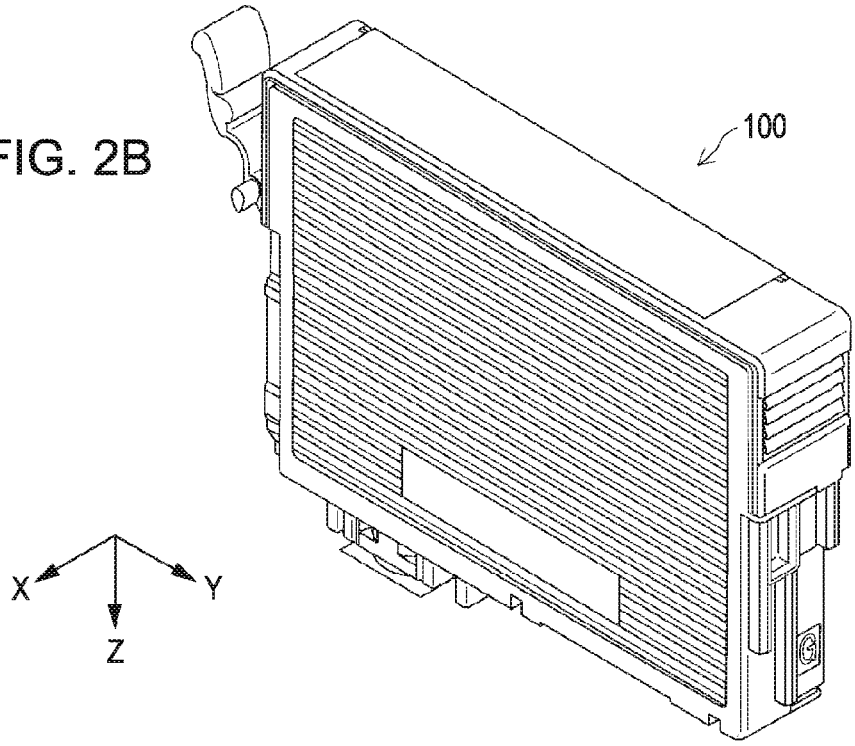

FIGS. 2A and 2B are perspective views showing the configuration of the ink cartridge related to this embodiment. The ink cartridge 100 includes a housing 101 that accommodates ink and a board 200 (also called a "circuit board"). An ink chamber 120 that accommodates the ink is formed inside the housing 101. At the bottom surface of the housing 101, an ink supply opening 110 through which the ink supply needle 6 of the printing apparatus is inserted when the ink cartridge is mounted in the holder 4 is formed. In a state before use, the opening of the ink supply opening 110 is sealed by a film. In addition, in the ink cartridge 100 and the carriage 3, a sensor mechanism for optically detecting an amount of ink remaining in the ink cartridge 100 is provided but illustration thereof is omitted here. Hereinafter, the ink cartridge is also simply called a "cartridge".

Figure 3A:
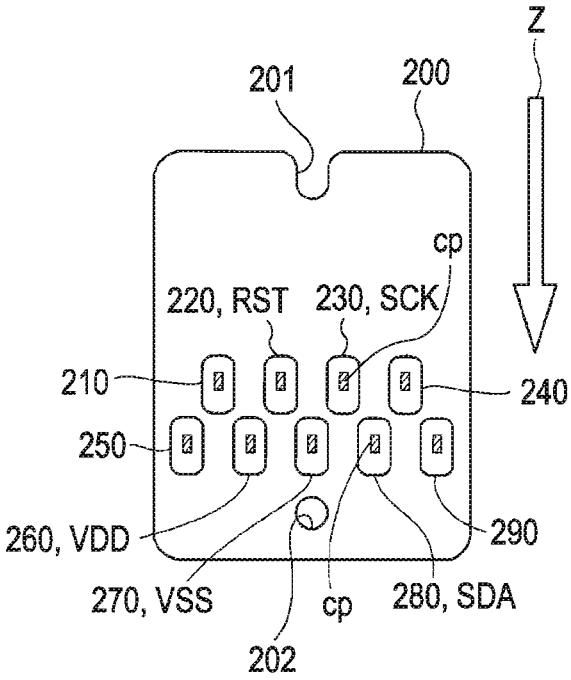
FIGS. 3A and 3B are diagrams showing the configuration of a board related to the embodiment.
Figure 3B:
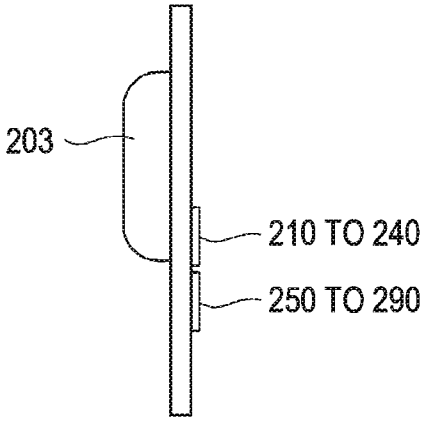

FIG. 3A shows the configuration of the front surface of the board 200. The front surface of the board 200 is a surface exposed to the outside when the board 200 is mounted to the cartridge 100. FIG. 3B is a diagram of the board 200 from a side view. At an upper end portion of the board 200, a boss groove 201 for fixing is formed, and at a lower end portion of the board 200, a boss hole 202 is formed.

In FIG. 3A, the arrow Z represents an insertion direction of the cartridge 100 to the holder 4. The board 200 includes a storage device 203 at the rear surface and includes a terminal group having 9 terminals 210 to 290 at the front surface. The storage device 203 stores information regarding a remaining ink amount of the cartridge 100. The terminals 210 to 290 are formed in substantially rectangular shapes and are disposed to form two rows substantially perpendicular to the insertion direction Z. From the two rows, the row positioned on the lower side in the insertion direction Z, that is, in FIG. 3A, is called a lower side row, and the row positioned on the opposite side in the insertion direction Z, that is, on the upper side in FIG. 3A is called an upper side row.

The terminals 210 to 240 forming the upper side row and the terminals 250 to 290 forming the lower side row are arranged in the following order.

<Upper Side Row>

(1) First overvoltage detection terminal 210

(2) Reset terminal 220

(3) Clock terminal 230

(4) Second overvoltage detection terminal 240

<Lower Side Row>

(5) First mounting detection terminal 250

(6) Power supply terminal 260

(7) Ground terminal 270

(8) Data terminal 280

(9) Second mounting detection terminal 290

The terminals 210 to 290 include respective contact portions cp at the center portions, which are connected to corresponding terminals from among a plurality of apparatus-side terminals. The corresponding contact portions cp of the terminals 210 to 240 forming the upper side row and the corresponding contact portions cp of the terminals 250 to 290 forming the lower side row are alternately disposed to form a so-called zigzag arrangement. In addition, the terminals 210 to 240 forming the upper side row and the terminals 250 and 290 forming the lower side row are alternately disposed and form the zigzag arrangement so that the terminal centers are not aligned with the insertion direction Z.

The first mounting detection terminal 250 is adjacent to two terminals (the power supply terminal 260 and the first overvoltage detection terminal 210), and the first overvoltage detection terminal 210 thereof is in the vicinity of the first mounting detection terminal 250 and is disposed particularly at the closest position to the first mounting detection terminal 250. Similarly, the second mounting detection terminal 290 is adjacent to two terminals (the second overvoltage detection terminal 240 and the data terminal 280), and the second overvoltage detection terminal 240 thereof is in the vicinity of the second mounting detection terminal 290 and is disposed particularly at the closest position to the second mounting detection terminal 290.

With regard to a relationship between the contact portions cp, the contact portion cp of the first mounting detection terminal 250 is adjacent to the contact portions cp of two terminals (the power supply terminal 260 and the first overvoltage detection terminal 210). Similarly, the contact portion cp of the second mounting detection terminal 290 is adjacent to the contact portions cp of two terminals (the second overvoltage detection terminal 240 and the data terminal 280).

As can be seen from FIG. 3A, the first and second mounting detection terminals 250 and 290 are disposed at both end portions of the lower side row, that is, at the outermost positions of the lower side row. In addition, the lower side row has a large number of terminals than the upper side row, so that the length of the lower side row in the direction substantially perpendicular to the insertion direction Z is lower than that of the upper side row. Therefore, the first and second mounting detection terminals 250 and 290 are disposed at the outermost positions as viewed in the direction substantially perpendicular to the insertion direction Z, from among the entire terminals 210 to 290 including the upper side row and the lower side row.

In addition, the contact portions cp of the first and second mounting detection terminals 250 and 290 are disposed at both end portions of the lower side row formed of the contact portions cp of the respective terminals, that is, at the outermost positions of the lower side row. In addition, the contact portions cp of the first and second mounting detection terminals 250 and 290 are disposed at the outermost positions as viewed in the direction substantially perpendicular to the insertion direction Z, from among the contact portions cp of the entire terminals 210 to 290 including the upper side row and the lower side row.

The first and second overvoltage detection terminals 210 and 240 are disposed at both end portions of the upper side row, that is, at the outermost positions of the upper side row. As a result, similarly, the contact portions cp of the first and second overvoltage detection terminals 210 and 240 are disposed at both end portions of the upper side row formed of the contact portions cp of the respective terminals, that is, at the outermost positions. Therefore, the terminals 220, 230, 260, 270, and 280 for the storage device 203 are disposed so as to be interposed between the first overvoltage detection terminal 210 and the first mounting detection terminal 250 which form a pair, and the second overvoltage detection terminal 240 and the second mounting detection terminal 290 which form a pair, from both sides.

B. Electrical Configuration of Printing Apparatus and Ink Cartridge

Figure 4:
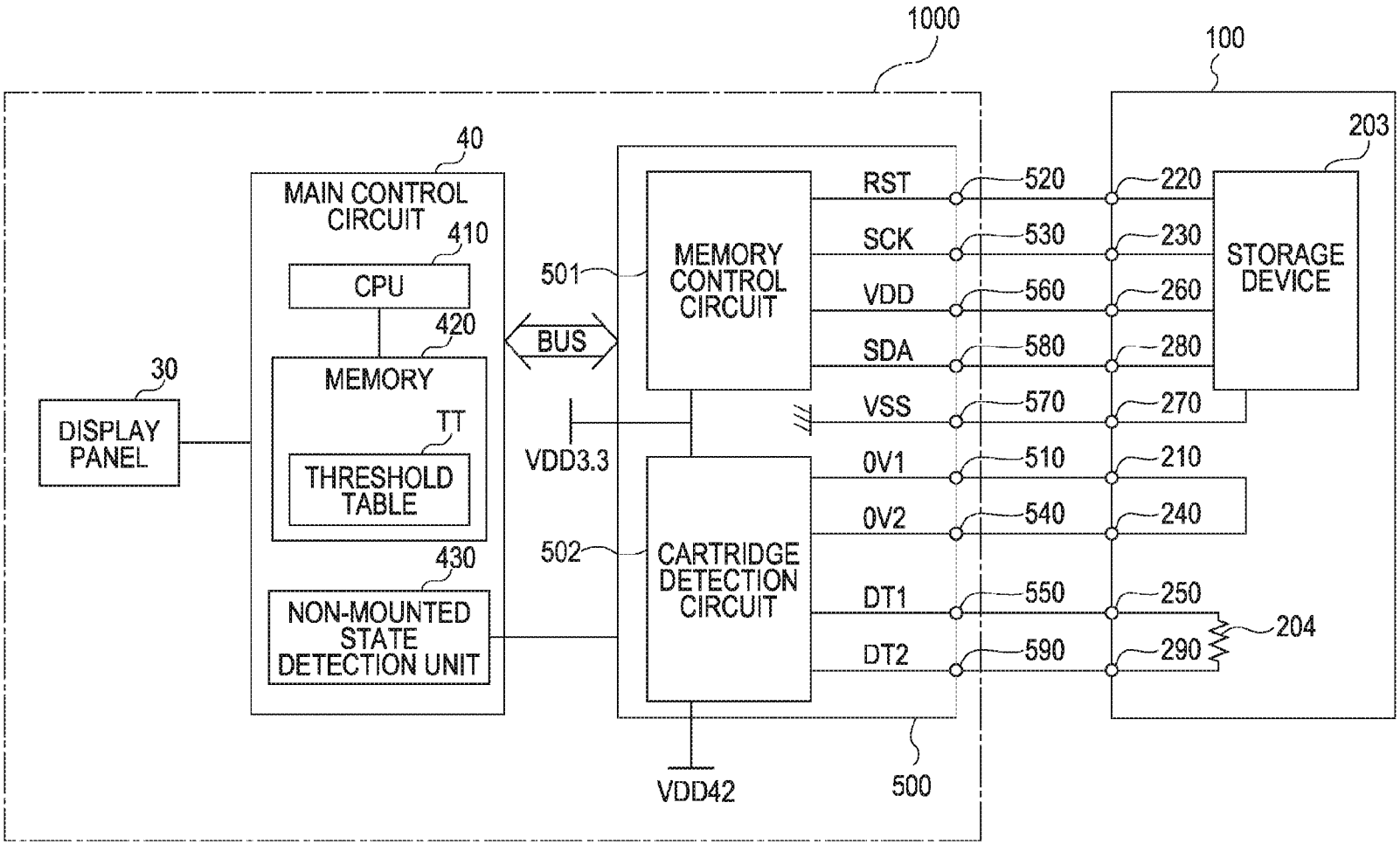
FIG. 4 is a block diagram showing the electrical configurations of the ink cartridge and the printing apparatus.

FIG. 4 is a block diagram showing the electrical configurations of the ink cartridge 100 and the printing apparatus 1000. The printing apparatus 1000 includes a display panel 30, the main control circuit 40, and a carriage circuit 500. The display panel 30 is a display unit for giving various notifications such as an operation state of the printing apparatus 1000 or a mounted state of the cartridge for users. The main control circuit 40 includes a CPU 410, a memory 420, and a non-mounted state detection unit 430. The memory 420 stores a threshold table TT storing thresholds used when existence of mounting of the cartridge is determined. The CPU 410 determines the kind of the cartridge mounted in the holder 4 using the threshold read from the threshold table TT (which will be described later). In addition, it is preferable that the threshold table TT be stored in a non-volatile memory such as an EEPROM. The carriage circuit 500 includes a memory control circuit 501 and a cartridge detection circuit 502.

From among the nine terminals provided in the board 200 (FIG. 3A) of the cartridge 100, the reset terminal 220, the clock terminal 230, the power supply terminal 260, the ground terminal 270, and the data terminal 280 are electrically connected to the storage device 203. The storage device 203 is, for example, a non-volatile memory which includes a memory cell array (not shown) which is serially accessed and performs reading and writing of data in synchronization with a clock signal SCK. The clock terminal 230 is electrically connected to a terminal 530 of the carriage circuit 500 and is used for supplying the clock signal SCK to the storage device 203 from the carriage circuit 500. To the power supply terminal 260 and the ground terminal 270, a power supply voltage (for example, 3.3V) and a ground voltage (0 V) are respectively supplied via terminals 560 and 570 on the printing apparatus 1000 side. The data terminal 280 is electrically connected to a terminal 580 of the carriage circuit 500 and is used for exchanging a data signal SDA between the carriage circuit 500 and the storage device 203. The reset terminal 220 is electrically connected to a terminal 520 of the carriage circuit 500 and is used for supplying a reset signal RST to the storage device 203 from the carriage circuit 500.

The first and second overvoltage detection terminals 210 and 240 are connected to each other with a wiring line in the board 200 (FIG. 3A) of the cartridge 100 and are electrically connected to the terminals 510 and 540 of the carriage circuit 500, respectively. In addition, a state where two terminals are connected to each other with a wiring line is called a "short circuit connection" or a "conducting wire connection". The short circuit connection by the wiring line is a different state from an unintended short circuit. The first and second mounting detection terminals 250 and 290 are provided with a resistive element 204 for mounting detection therebetween and are electrically connected to terminals 550 and 590 of the carriage circuit 500, respectively.

The memory control circuit 501 is a circuit which performs reading and writing of data by controlling the storage device 203 of the cartridge 100. The memory control circuit 501 and the storage device 203 of the cartridge are low-voltage circuits operating at a relatively low voltage (in this embodiment, rating 3.3V).

The cartridge detection circuit 502 is a circuit for performing mounting detection of the cartridge in the holder 4 by cooperating with the main control circuit 40. In addition, the cartridge detection circuit 502 and the main control circuit 40 are collectively called a "mounting detection circuit". The cartridge detection circuit 502 and the resistive element 204 of the cartridge are high-voltage circuits operating at a higher voltage (in this embodiment, rating 42V) than that of the storage device 203.

Figure 5:
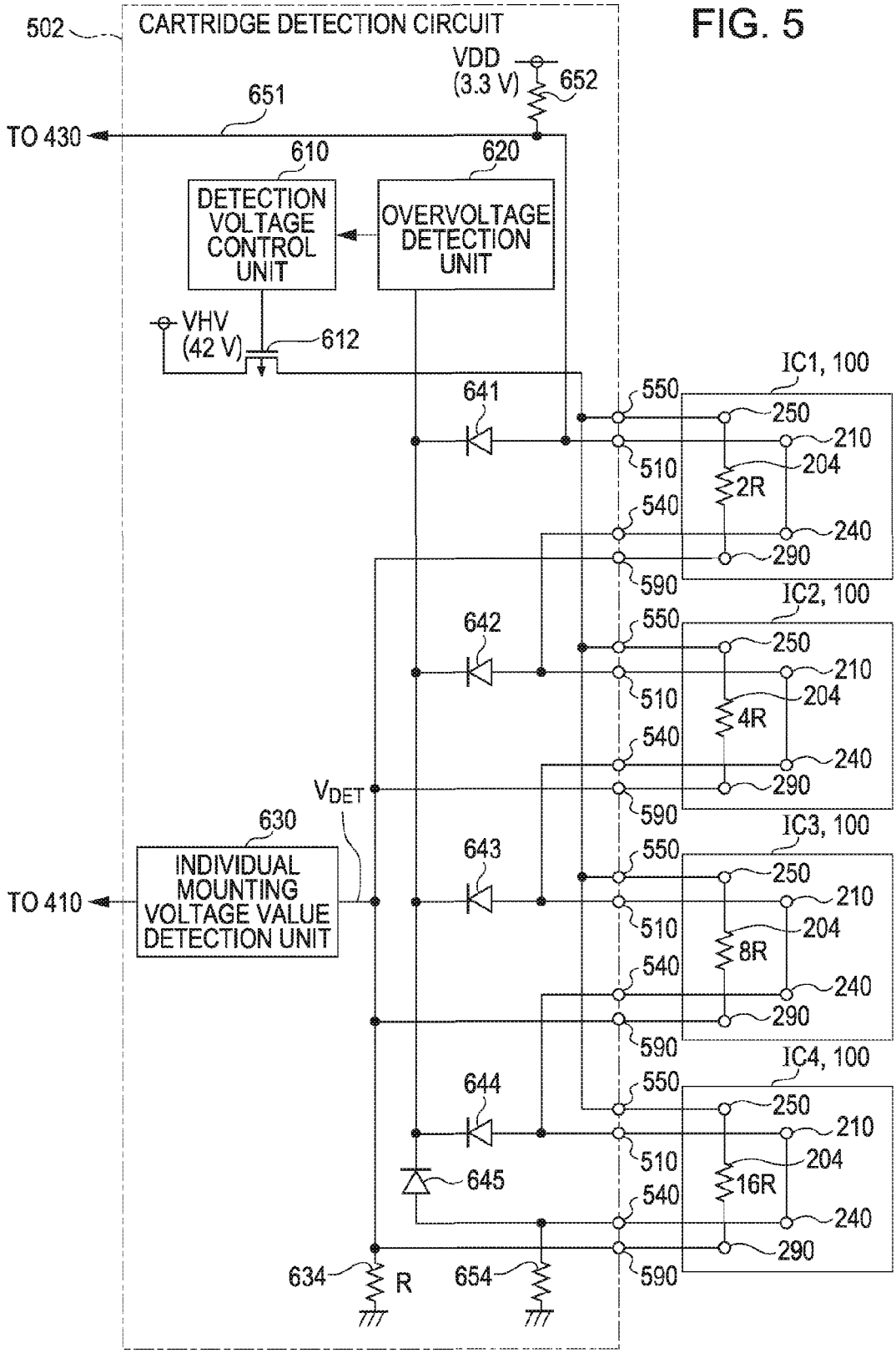
FIG. 5 is a block diagram showing the internal configuration of a cartridge detection circuit.

FIG. 5 is a block diagram showing the internal configuration of the cartridge detection circuit 502. Here, a state where four cartridges 100 are mounted n the holder is shown, and reference numerals IC1 to IC4 are used for distinguishing the cartridges. The cartridge detection circuit 502 includes a detection voltage control unit 610, an overvoltage detection unit 620, and an individual mounting voltage value detection unit 630.

The cartridge detection circuit 502 is provided with a high-voltage power supply VHV for mounting detection. The high-voltage power supply VHV is connected to the four apparatus-side terminals 550 provided at mounting positions of the respective cartridges IC1 to IC4 via a transistor 612 in parallel. In addition, the voltage value of the high-voltage power supply VHV is called a "high-voltage VHV". On and OFF of the transistor 612 is controlled by the detection voltage control unit 610. Each apparatus-side terminal 550 is connected to the first mounting detection terminal 250 of the corresponding cartridge. In each of the cartridges, the resistive element 204 is provided between the first and second mounting detection terminals 250 and 290. Here, in the four cartridges IC1 to IC4, the resistance values of the resistive elements 204 are set to be different from each other. Specifically, the resistance value of the resistive element 204 of the n-th (n=1 to 4) cartridge ICn is set to $2^{n}$R (R is a constant value). The second mounting detection terminals 290 of the four cartridges IC1 to IC4 are connected to the individual mounting voltage value detection units 630 via the corresponding apparatus-side terminals 590 in parallel. In addition, the apparatus-side terminals 590 are ground via a reference resistor 634 provided in the cartridge detection circuit 502. The resistance value R of the reference resistor 634 is set to a value of ½ the resistance value 2R of the resistive element 204 in the cartridge. As can be understood by FIG. 5, the resistive elements 204 for mounting detection of the four cartridges IC1 to IC4 are connected to the cartridge detection circuit 502 in parallel. The individual mounting voltage value detection unit 620 is a circuit that detects a detection voltage $V_{DET}$ determined depending on the mounting state of the cartridge. The detection voltage $V_{DET}$ is also called an "individual mounting detection voltage" or simply a "mounting detection voltage". The voltage of the detection voltage $V_{DET}$ will be described later.

In each of the cartridges, the first and second overvoltage detection terminals 210 and 240 are connected with a wiring line. The first overvoltage detection terminal 210 of the first cartridge IC1 is connected to a wiring line 651 in the cartridge detection circuit 502 via the corresponding apparatus-side terminal 510, and the wiring line 651 is connected to a low-voltage power supply VDD via a resistor 652. In addition, the wiring line 651 is connected to the non-mounted state detection unit 430 (FIG. 4) in the main control circuit 40. The voltage value of the low-voltage power supply VDD is also called a "low voltage VDD". The second overvoltage detection terminal 240 of the n-th(n=1 to 3) cartridge and the first overvoltage detection terminal 210 of the (n+1)-th cartridge are connected to each other via the corresponding apparatus-side terminals 540 and 510. In addition, the second overvoltage detection terminal 240 of the fourth cartridge IC4 is connected to a ground potential via a resistor 654. When all the cartridges IC1 to IC4 are mounted in the holder, the voltage of the wiring line 651 connected to the non-mounted state detection unit 430 becomes a predetermined voltage value obtained by dividing the power source voltage VDD by the two resistors 652 and 654. On the other hand, when there is any non-mounted cartridge, the voltage of the wiring line 651 becomes the power supply potential VDD. Therefore, the non-mounted state detection unit 430 can determine whether or not a non-mounted cartridge exists by monitoring the voltage of the wiring line 651. As such, in this embodiment, when all the cartridges IC1 to IC4 are mounted in the holder, the overvoltage detection terminals 240 and 210 of the cartridges are sequentially connected in series, so that it is possible to immediately determine whether or not one or more cartridges are not mounted by detecting the voltage of the wiring line 651 at the connection destination.

Furthermore, the first overvoltage detection terminals 210 of the four cartridges IC1 to IC4 are connected to the anode terminals of diodes 641 to 644 via the corresponding apparatus-side terminals 510. In addition, the second overvoltage detection terminals 240 of the four cartridges IC1 to IC4 are connected to the anode terminals of diodes 642 to 645 via the corresponding apparatus-side terminals 540. The anode terminal of the second diode 642 is commonly connected to the second overvoltage detection terminal 240 of the first cartridge IC1 and the first overvoltage detection terminal 210 of the second cartridge IC2. Similarly, each of the diodes 643 and 644 is commonly connected to the second overvoltage detection terminal 240 of one cartridge and the first overvoltage detection terminal 210 of the adjacent cartridge. The cathode terminals of the diodes 641 to 645 are connected to the overvoltage detection unit 620 in parallel. The diodes 641 to 645 are used for monitoring whether or not an abnormally high voltage (specifically, a voltage that exceeds the voltage value of the low-voltage power supply VDD) is applied to the overvoltage detection terminals 210 and 240. Such an abnormal voltage value (called an "overvoltage") is generated in a case where an unintended short circuit occurs between any one of the overvoltage detection terminals 210 and 240 and any one of the mounting detection terminals 250 and 290 in each of the cartridges. For example, when ink droplets or dirt is attached to the surface of the board 200 (FIG. 3A), there is a possibility of an unintended short circuit occurring between the first overvoltage detection terminal 210 and the first mounting detection terminal 250 or between the second overvoltage detection terminal 240 and the second mounting detection terminal 290. When such an unintended short circuit occurs, current flows to the overvoltage detection unit 620 via any one of the diodes 641 to 645, so that the overvoltage detection unit 620 can determine existence of generation of an overvoltage or existence of generation of an unintended short circuit. In addition, when an overvoltage is detected, a signal indicating generation of the overvoltage is supplied from the overvoltage detection unit 620 to the detection voltage control unit 610, and accordingly, the transistor 612 is set to OFF by the detection voltage control unit 610. This is for preventing damage of the printing apparatus or the cartridge that may occur due to the overvoltage. In addition, the overvoltage detection unit 620 can also be called a "short circuit detection unit".

As described above, in this embodiment, the overvoltage detection terminals 210 and 240 are used for both a process (mounting detection of the entire cartages) for detecting whether or not all the cartridges are mounted in the holder 4 and a process of detecting existence of an unintended short circuit between the overvoltage detection terminals 210 and 240 and the mounting detection terminals 250 and 290. Here, one or both of the two detecting processes may also be omitted. When neither of the two detecting processes using the overvoltage detection terminals 210 and 240 is not performed, circuit elements such as the terminals 210, 240, 510, and 540, the diodes 641 to 645, and the overvoltage detection unit 620 may also be omitted.

Figure 6A:
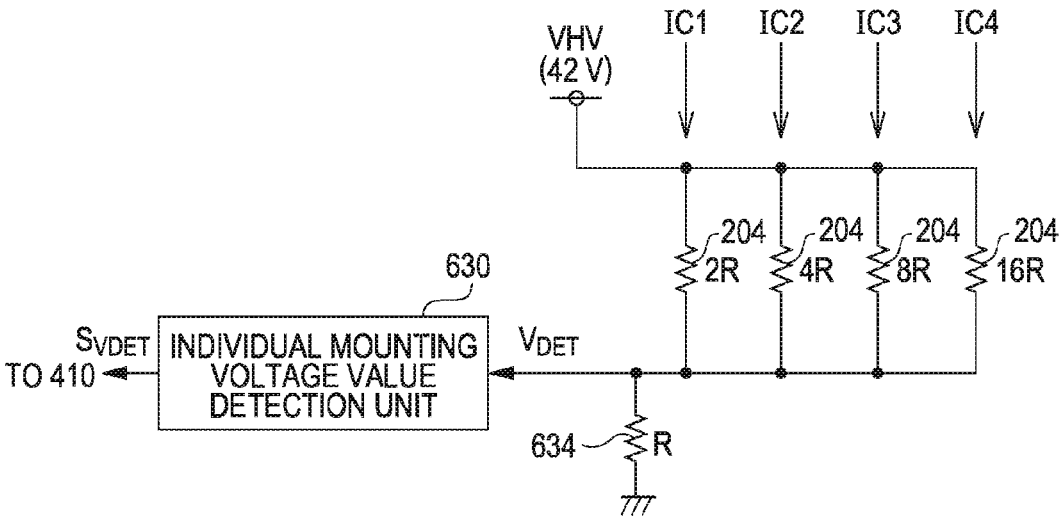
FIGS. 6A and 6B are explanatory views showing contents of an individual mounting detection process of the cartridges.
Figure 6B:
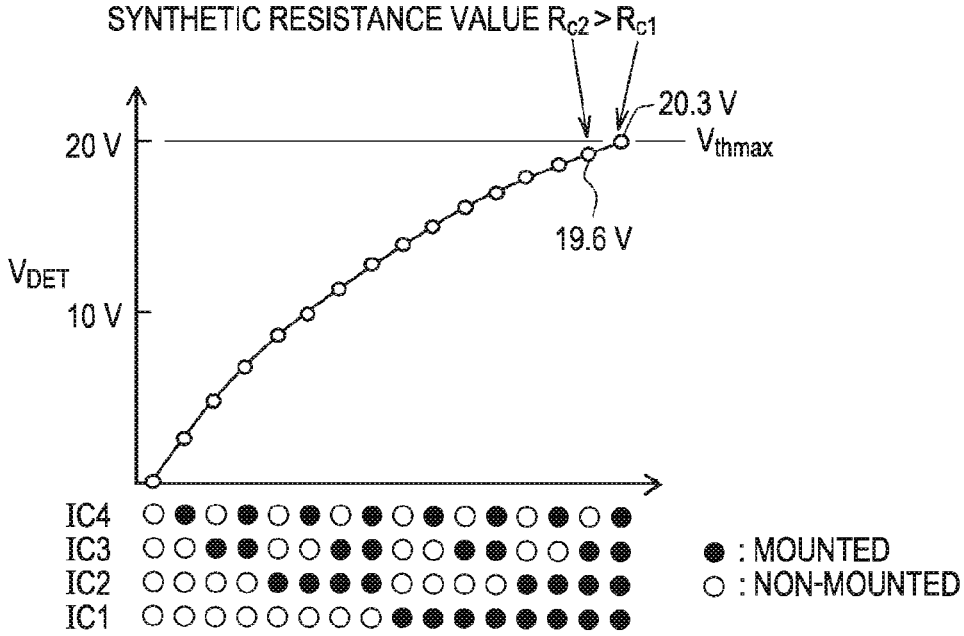

FIGS. 6A and 6B are explanatory views showing contents of an individual mounting detection process of the cartridges performed by the individual mounting voltage value detection unit 630 and the CPU 410. FIG. 6A shows a state where the four cartridges IC1 to IC4 are all mounted. The resistive elements 204 of the four cartridges are connected in parallel between a high-voltage power supply VHV and the individual mounting voltage value detection unit 630. A detection voltage $V_{DET}$ detected by the individual mounting voltage value detection unit 630 is a value obtained by dividing the high voltage VHV by a synthetic resistance value Rc of the resistive elements 204 and a resistance value R of the reference resistor 634. Here, when the number of cartridges is assumed to be N, in a case where the N cartridges are all mounted, the detection voltage $V_{DET}$ is given by the following expression.

$$V_{DET} = VHV\frac{R}{R + R_c} \tag{1}$$

$$R_c = R\frac{1}{\sum_{j=1}^{N}\frac{1}{2^j}} \tag{2}$$

In addition, when one or more cartridges are not mounted, accordingly, the synthetic resistance value Rc is increased, and the detection voltage $V_{DET}$ is reduced.

FIG. 6B shows a relationship between the mounted states of the cartridges IC1 to IC4 and the detection voltages $V_{DET}$. The horizontal axis in the figure represents 16 kinds of mounted states, and the vertical axis represents the values of the detection voltages $V_{DET}$ in these mounted states. The 16 kinds of mounted states correspond to 16 combinations obtained by arbitrarily selecting one to four from among the four cartridges IC1 to IC4. In addition, each individual combination is also called a "subset". The detection voltages $V_{DET}$ become voltage values that can uniquely identify the 16 kinds of mounted states. In other words, the resistance values of the resistive elements 204 of the four cartridges IC1 to IC4 are set to give different synthetic resistance values Rc depending on the 16 kinds of mounted states acquired by the four cartridges.

When the voltage of the high voltage VHV is 42V, if the four cartridges IC1 to IC4 are all in the mounted states, the detection voltage $V_{DET}$ becomes 20.3V. On the other hand, when only the cartridge IC4 having the resistive element 204 with the largest resistance value is in a non-mounted state, the detection voltage $V_{DET}$ becomes 19.6V. Therefore, by inspecting whether or not the detection voltage $V_{DET}$ is equal to or higher than a threshold voltage $V_{thmax}$ set in advance as a value between such voltages, whether or not the four cartridges IC1 to IC4 are all mounted can be detected. In addition, the reason that the voltage VHV higher than the power supply voltage (about 3.3V) of a typical logic circuit is used for individual mounting detection is to widen the dynamic range of the detection voltage $V_{DET}$ and increase detection precision.

The individual mounting voltage value detection unit 630 converts the detection voltage $V_{DET}$ into a digital signal $S_{VDET}$ and transmits the detection voltage signal $S_{VDET}$ to the CPU 410 (FIG. 4) of the main control circuit 40. The CPU 410 can determine one from among the 16 kinds of the mounted states by sequentially comparing the value of the detection voltage signal $S_{VDET}$ to 15 thresholds stored in the threshold table TT in advance. That is, the CPU 410 has a function as a determination circuit that determines the mounted state from the detection voltage value $V_{DET}$.

Figure 7:
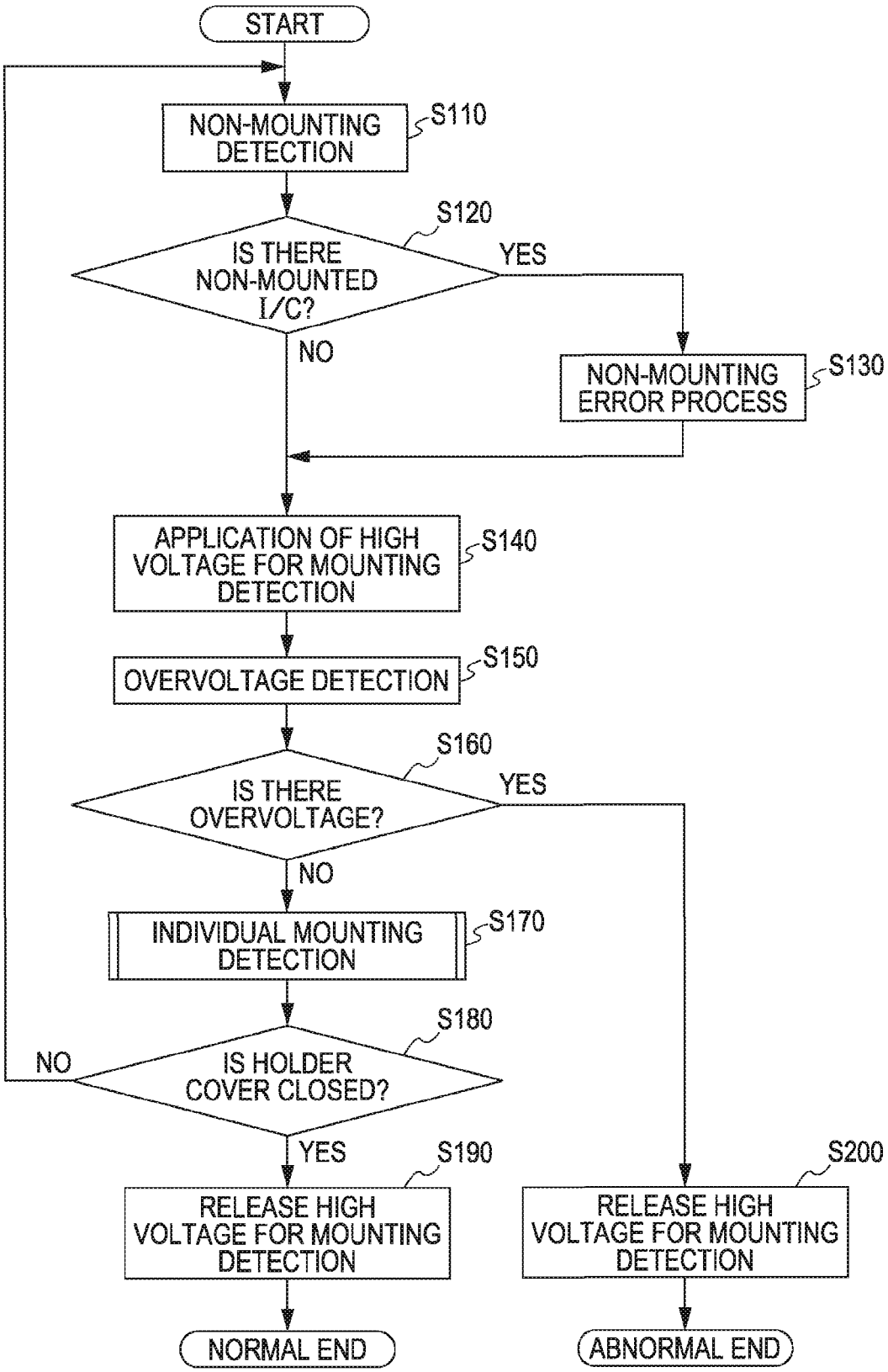
FIG. 7 is a flowchart showing a process order of a mounting detection process.

FIG. 7 is a flowchart showing a process order of a mounting detection process performed by the main control circuit 40 and the cartridge detection circuit 502. The mounting detection process is started when the carriage 3 is stopped at a position for cartridge replacement (called a "cartridge replacement position") and the cover 11 (FIG. 1) of the holder 4 is opened. The cartridge replacement position is set to the vicinity of one end side of the carriage 3 in the main scanning direction (for example, the vicinity of the right end of FIG. 1) in advance. In addition, at the cartridge replacement position, the storage device 203 of the cartridge is not in an electrically connected state (a state where the power supply voltage VDD is not supplied).

When the carriage 3 is stopped at the cartridge replacement position, in Steps S110 and S120, the non-mounted state detection unit 430 (FIG. 4) detects whether or not all the cartridges are mounted in the holder 4. When all the cartridges are mounted, the process proceeds to S140 described later from Step S120. On the other hand, when one or more cartridges are not mounted, in Step S130, the main control circuit 40 performs a predetermined non-mounting error process. The non-mounting error process is, for example, a process for displaying a notification such as "cartridge is not correctly mounted" (a notification that there is a non-mounted cartridge) on the display panel 30. In Step S140, the detection voltage control unit 610 (FIG. 5) of the cartridge detection circuit 502 switches the transistor 612 from OFF to ON, such that the high voltage VHV for mounting detection is applied to a device for detecting mounting of the cartridge (specifically, the resistive element 204). In Steps S150 and S160, the overvoltage detection unit 620 detects whether or not an overvoltage (a voltage higher than the power supply voltage VDD) is generated. When an overvoltage is generated, in Step S200, the overvoltage detection unit 620 notifies the detection voltage control unit 610 of the generation of the overvoltage and turns off the transistor 612. In this case, the intent that the overvoltage is generated, an instruction to perform an operation of detaching the cartridge once and re-inserting, or the like may be displayed on the display panel 30. On the other hand, when an overvoltage is not generated, the process proceeds to Step S170 from Step S160, and the individual mounting detection process of the cartridge is performed.

Figure 8:
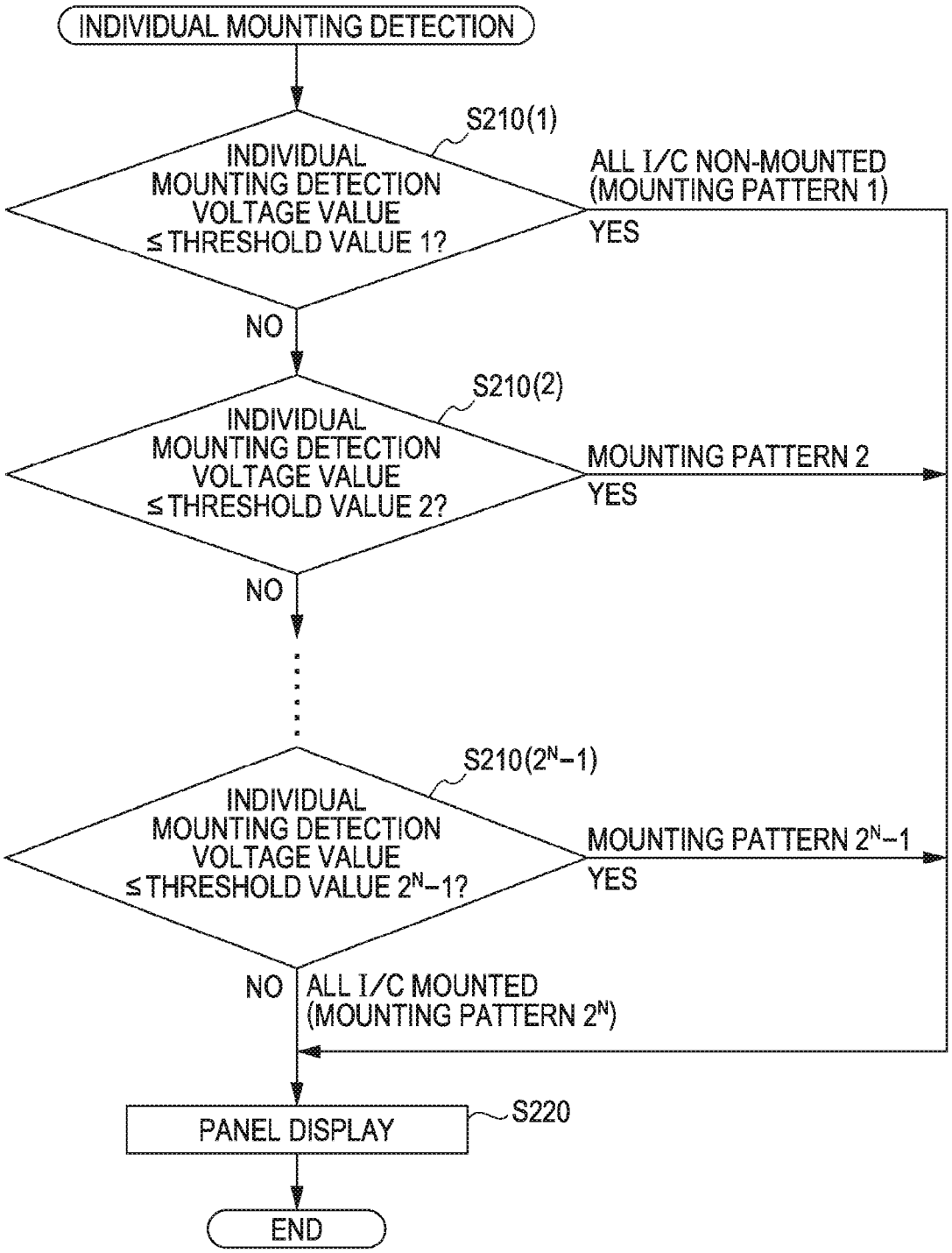
FIG. 8 is a flowchart showing a detailed order of the individual mounting detection process.

FIG. 8 is a flowchart showing a detailed order of the individual mounting detection process. In Step S210(1), the CPU 410 compares the value of the detection voltage signal $S_{VDET}$ supplied from the individual mounting voltage value detection unit 630 to the first threshold. The first threshold is a value set in advance to correspond to a voltage value between the detection voltage value $V_{DET}$ in the case where all the cartridges are not mounted and the detection voltage value $V_{DET}$ in the case where the cartridge IC4 having the resistive element 204 with the highest resistance value is mounted. When the detection voltage value $V_{DET}$ is equal to or lower than the first threshold, all the cartridges are not mounted, so that the intent is displayed on the display panel 30 in Step S220 and the process is ended. Similarly, until Step S210($2^N$−1), by comparing the thresholds set in advance to the detection voltage value $V_{DET}$, one is determined from among $2^N$ mounted states (mounted patterns) shown in the lower section of FIG. 6B, and the determination results (the kind of non-mounted cartridge) can be displayed on the display panel 30. In addition, in this embodiment, since N=4, 15 thresholds are used.

In this manner, when the individual mounting detection process is ended, the process returns to Step S180 of FIG. 7 to determine whether or not the cover 11 of the holder 4 is closed. When the cover 11 is not closed, the process returns to Step S110 from Step S180, and the process after Step S110 described above is performed again. On the other hand, when the cover 11 is closed, in Step S190, the detection voltage control unit 610 turns off the transistor 612 for mounting detection, and the process is completed.

As such, in this embodiment, since the non-mounted state of individual cartridges is displayed on the display panel 30 in the middle of the replacement of the cartridge, so that the user can perform the cartridge replacement while seeing the display. In particular, when a new cartridge is mounted in the holder 4 during the cartridge replacement, the intent that the cartridge is mounted is displayed on the display panel 30, so that a user who is unaccustomed to the cartridge replacement operation can proceed to the next operation without anxiety. In addition, in this embodiment, the cartridge detachment and mounting detection can be performed while the storage device 203 of the cartridge is not in the electrically connected state, so that it is possible to prevent generation of a bit error that occurs due to so-called hot swapping of the storage device.

In addition, in this embodiment, in the case where an overvoltage is generated in the overvoltage detection terminals 250 and 290, application of the high voltage VHV for mounting detection is immediately released, so that damage of the electrical circuit of the printing apparatus or the cartridge due to the overvoltage can be prevented.

C. Allowable Error of Resistive Element for Mounting Detection of Cartridge

As described with reference to FIGS. 6A and 6B, the individual mounting detection process of the cartridge uses the fact that the synthetic resistance values Rc are uniquely determined depending on $2^N$ kinds of mounted states related to N cartridges and accordingly the detection voltages $V_{DET}$ are uniquely determined. Hereinafter, the allowable error of the resistance value of the resistive element 204 of the cartridge will be examined.

First, a case where the number N of cartridges is 4 is considered. When the allowable error of the resistance value is assumed to be ϵ, the resistance values of the four resistive elements 204 (FIG. 6A) are allowed to respectively have values in ranges of (1±ϵ)2R, (1±ϵ)4R, (1±ϵ)8R, and (1±ϵ)16R. However, from among the 16 kinds of mounted states of FIG. 6B, two states which have a smallest difference between their synthetic resistance values Rc and therefore have highest detection voltages $V_{DET}$ are the state where all the cartridges IC1 to IC4 are mounted and the state where only the fourth cartridge IC4 is not mounted. Here, when it is assumed that the first synthetic resistance value of the state where all the cartridges IC1 to IC4 are mounted is $R_{c1}$ and the second synthetic resistance value of the state where only the fourth cartridge IC4 is not mounted is $R_{c2}$, $R_{c1}<R_{c2}$ is formed. It is preferable that this relationship be formed even in the case where the resistance values of the resistive elements 204 vary in the ranges of the allowable errors ϵ. Here, the worst condition is a case where the first synthetic resistance value $R_{c1}$ has its maximum value $R_{c1max}$ and the second synthetic resistance value $R_{c2}$ has its minimum value $R_{c2min}$. Here, it is preferable that $R_{c1max}<R_{c2min}$ be formed, and when this is rewritten, the following expression is formed.

$$\frac{1}{R_{c2min}} < \frac{1}{R_{c1max}} \tag{3}$$

where $R_{c1max}$ is the synthetic resistance value of the state where all the cartridges are mounted, and $R_{c2min}$ is the synthetic resistance value of the state where only the fourth cartridge is not mounted.

$R_{c1max}$ and $R_{c2min}$ of Expression 3 are given by the following expressions.

$$\frac{1}{R_{c1max}} = \frac{1}{(1+\varepsilon)R}\left\{\frac{1}{2}+\frac{1}{4}+\frac{1}{8}+\frac{1}{16}\right\} \tag{4}$$

$$\frac{1}{R_{c2min}} = \frac{1}{(1-\varepsilon)R}\left\{\frac{1}{2}+\frac{1}{4}+\frac{1}{8}\right\} \tag{5}$$

When Expression 3 is substituted by Expressions 4 and 5, Expression 6 is formed as follows, and this is transformed into Expression 7.

$$\frac{1}{(1-\varepsilon)R}\left\{\frac{1}{2}+\frac{1}{4}+\frac{1}{8}\right\} < \frac{1}{(1+\varepsilon)R}\left\{\frac{1}{2}+\frac{1}{4}+\frac{1}{8}+\frac{1}{16}\right\} \tag{6}$$

$$\frac{2\varepsilon}{1-\varepsilon} < \frac{1}{16}\times\frac{8}{7} \tag{7}$$

In Expression 7, since the error ϵ is sufficiently smaller than 1, the following expression is formed assuming that (1−ϵ)=1, and the allowable error ϵ of the resistance value becomes 3.6%.

$$\epsilon<0.036=3.6\% \tag{8}$$

When the above consideration is generalized, when the number of cartridges is N, the allowable error ϵ is given by the following expression.

$$\varepsilon < \frac{1}{4(2^{N-1}-1)} \tag{9}$$

That is, when the allowable error ϵ satisfies Expression 9, the synthetic resistance values Rc are always uniquely determined depending on the mounted states of the N cartridges, and accordingly, it can be guaranteed that the detection voltages $V_{DET}$ are uniquely determined. Here, it is preferable that the allowable error of the resistance value in actual design be set to a value smaller than the value of the right side of Expression 9. In addition, without the above-described examination, the allowable error of the resistance value of the resistive element 204 may be set to a sufficiently small value (for example, a value equal to or lower than 1%).

D. Another Embodiment

Figure 9:
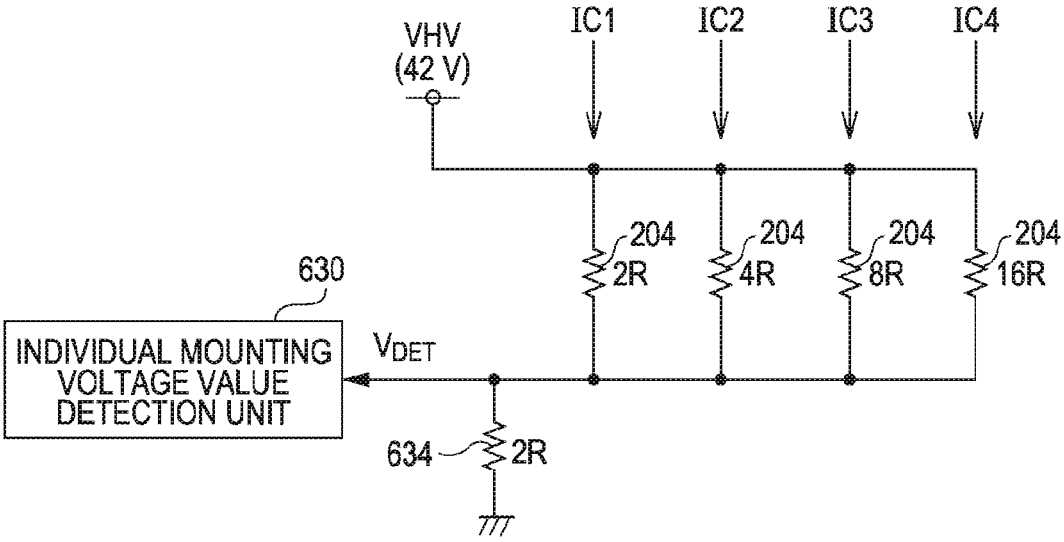
FIG. 9 is a circuit diagram of an individual mounting detection unit according to another embodiment.

FIG. 9 is a circuit diagram showing the configuration of an individual mounting detection unit according to another embodiment. This circuit is different from the circuit of FIG. 6A in only the resistance values of the reference resistors 634. That is, the resistance value of the reference resistor 634 is R in FIGS. 6A and 2R in FIG. 9. Similarly to FIG. 6B, the circuit of FIG. 9 also obtains characteristics in which the detection voltages $V_{DET}$ are uniquely determined depending on $2^N$ kinds of mounted states of N cartridges. As such, the resistance value of the reference resistor 634 can be selected to have no relation to the resistance value of the resistive element 204 of the cartridge. In addition, the actual individual mounting detection unit includes a determination circuit (for example, the CPU 410 of FIG. 4) that determines the mounted state from the detection voltage value $V_{DET}$; however, illustration thereof is omitted in FIG. 9.

Figure 10:
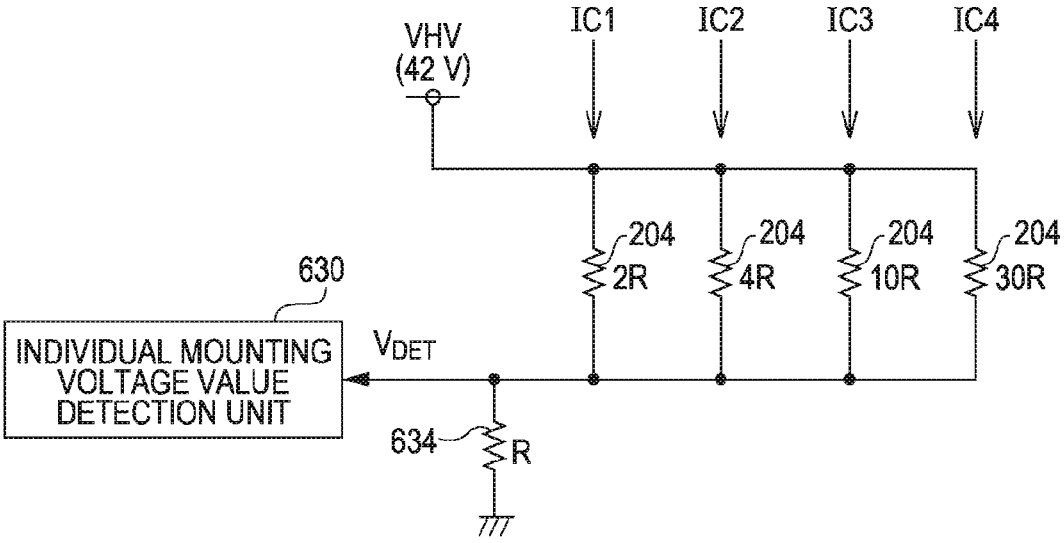
FIG. 10 is a circuit diagram of an individual mounting detection unit according to another embodiment.

FIG. 10 is a circuit diagram showing the configuration of an individual mounting detection unit according to still another embodiment. This circuit is different from the circuit of FIG. 6A in only the resistance values of the reference resistors 204. That is, in the circuit of FIG. 10, the resistance values of the four cartridges IC1 to IC4 are 2R, 4R, 10R, and 30R, respectively. Here, ratios of the resistance values between two cartridges are 2, 2.5, and 3 and thus have different values. In general, when a value of equal to or greater than 2 is employed as the ratio of resistance values of two cartridges, a circuit configuration in which synthetic resistance values Rc are uniquely determined depending on $2^N$ kinds of mounted states of N cartridges can be obtained. As understood from this example, the resistance values of the resistive elements 204 of the cartridges do not need to be $2^n$R, and may employ various values so as to uniquely determine the synthetic resistance values Rc depending on the $2^N$ kinds of mounted states of the N cartridges.

Figure 11:
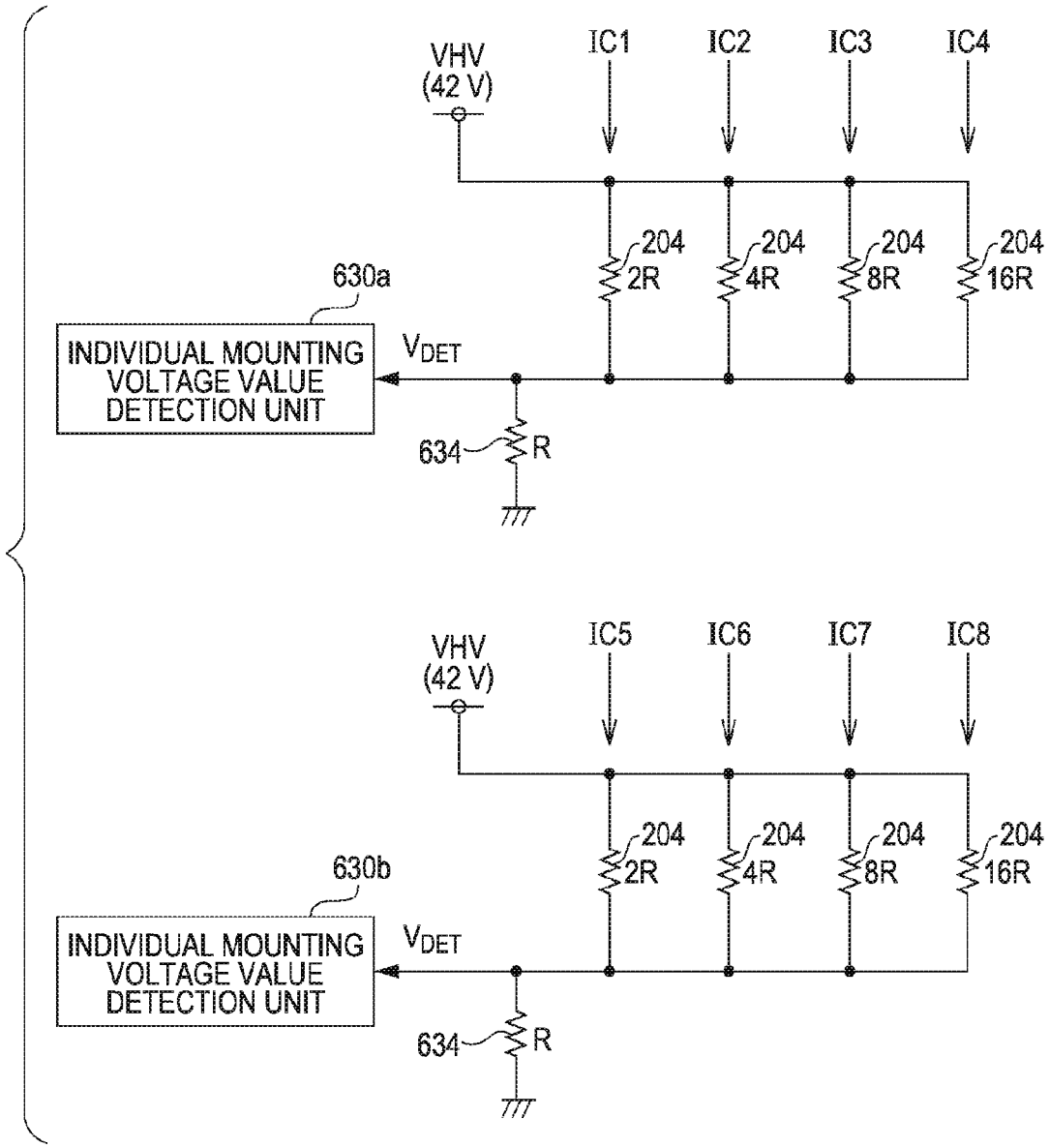
FIG. 11 is a circuit diagram of an individual mounting detection unit according to another embodiment.

FIG. 11 is a circuit diagram showing the configuration of an individual mounting detection unit according to further another embodiment. This circuit is a circuit for 8 cartridges IC1 to IC8. Four cartridges IC1 to IC4 and four different cartridges IC5 to IC8 form different individual mounting detection units, so that individual mounting voltage value detection units 630*a* and 630*b* are provided respectively. As such, individual mounting detection of all cartridges mounted in the printing apparatus does not need to be detected by a single individual mounting detection unit, and the cartridges may be divided into a plurality of groups so that individual mounting detection is performed in each of the groups. In addition, the number of cartridges included in each of the groups may vary. When grouping of the cartridges is performed as described above, the above-mentioned allowable error $\epsilon$ is not excessively reduced even though the number of cartridges mounted in the printing apparatus is increased, so that the individual mounting detection units can be easily configured.

Figure 12:
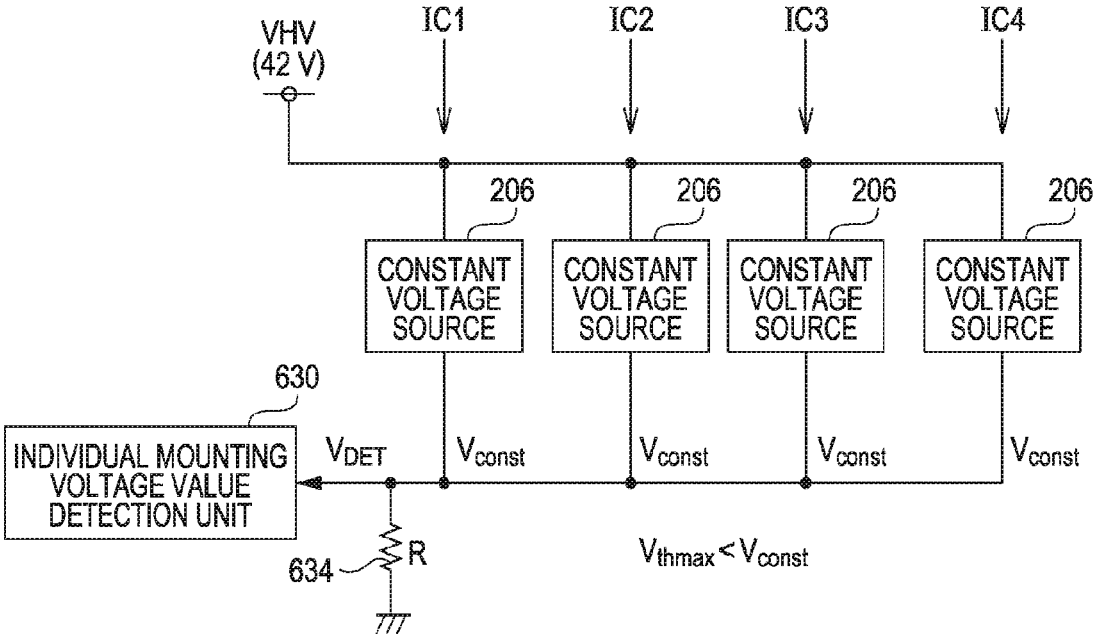
FIG. 12 is a circuit diagram of an individual mounting detection unit according to another embodiment.

FIG. 12 is a circuit diagram showing the configuration of an individual mounting detection unit according to still further another embodiment. This circuit is configured by substituting the resistive element 204 of the cartridge in FIG. 6A with a constant-voltage source 206. The constant-voltage source 206 receives the high voltage VHV and outputs a constant voltage $V_{const}$. The constant voltage $V_{const}$ is set to a value higher than the threshold voltage $V_{thmax}$ shown in FIG. 6B. Even in this configuration, the CPU 410 (determination circuit) can determine that the cartridges are mounted. In addition, in the configuration of FIG. 12, individual mounting detection cannot be performed; however, the configuration can be used for special purposes (when a test or cleaning is desired in a single cartridge is mounted, when individual mounting detection is not to be performed, and the like).

In addition, in FIG. 12, instead of the constant-voltage source 206, the same resistive elements 204 having a resistance value of N×Rc which is N times the synthetic resistance value Rc shown in FIG. 6A may be mounted in all the cartridges. In this configuration, when all the cartridges are mounted, since the detection voltage $V_{DET}$ becomes greater than the threshold voltage $V_{thmax}$, it is possible to correctly determine that there is no non-mounted cartridge when all the cartridges are mounted.

In addition, as electric devices connected to the mounting detection terminals 250 and 290 (FIGS. 3A and 4) of the cartridges, as well as the resistive element 204 or the constant-voltage source 206, an arbitrary kind of electric device can be employed. However, it is preferable that such an electric device be configured so that when N cartridges are all mounted in the holder 4, the detection voltage $V_{DET}$ for individual mounting detection becomes equal to or greater than the threshold voltage $V_{thmax}$ set in advance.

Figure 13:
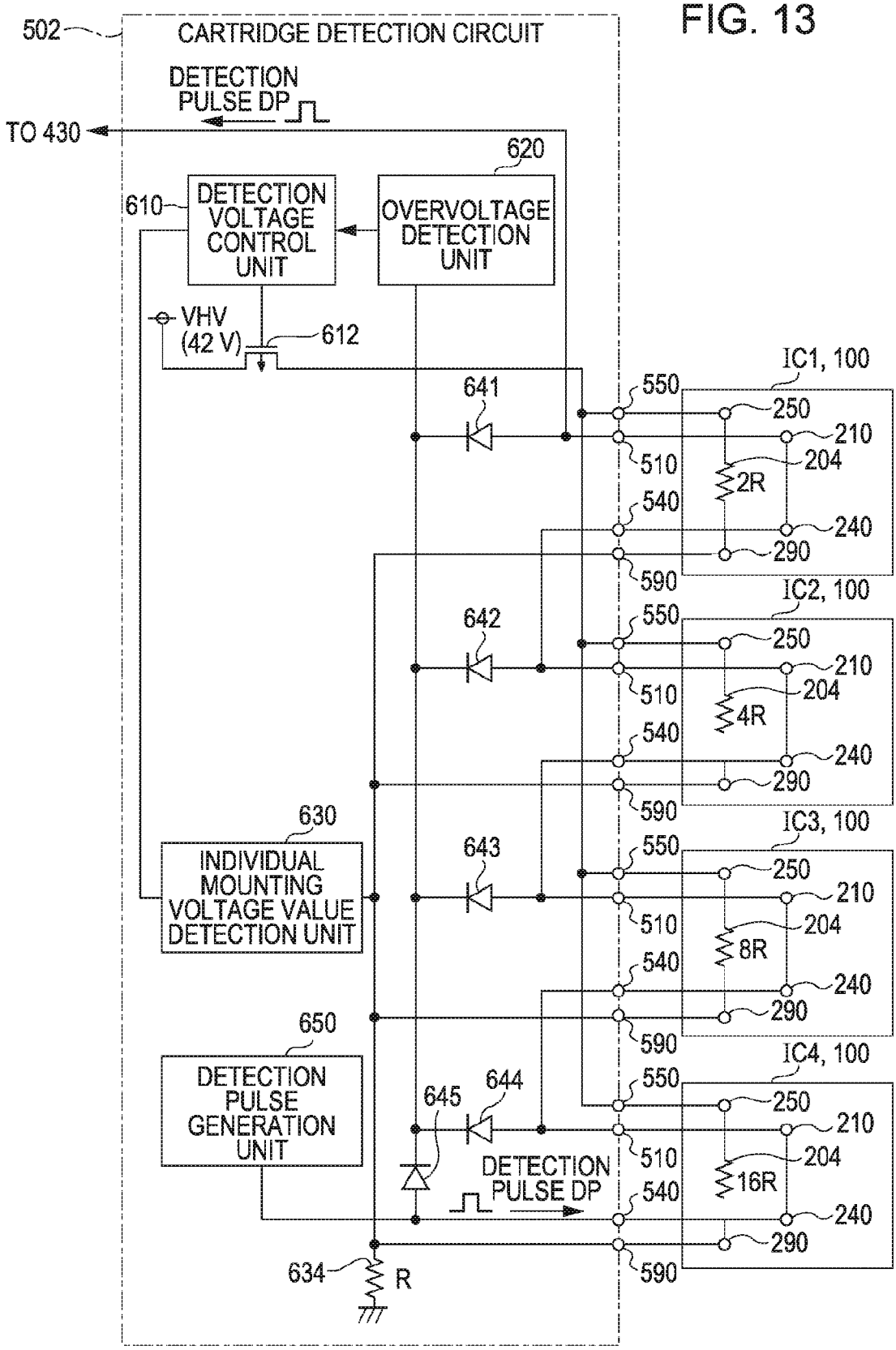
FIG. 13 is a circuit diagram of a cartridge detection circuit according to another embodiment.

FIG. 13 is a circuit diagram showing the configuration of a cartridge detection circuit according to another embodiment. In this circuit, the resistors 652 and 654 illustrated in the cartridge detection circuit shown in FIG. 5 are omitted, and instead of this, a detection pulse generation unit 650 is provided, and other configurations of the circuit are the same as those of FIG. 5. The detection pulse generation unit 650 generates a rectangular detection pulse DP in Step S110 of FIG. 7. The detection pulse DP sequentially passes through the overvoltage detection terminals 240 and 210 of all the ink cartridges and thereafter is received by the non-mounted state detection unit 430 (FIG. 4). The non-mounted state detection unit 430 can determine whether or not the contact state of the terminal of the ink cartridge is in an insufficient contact state (loose contact) due to a high voltage by analyzing the waveform of the detection pulse DP. That is, the non-mounted state detection unit 430 can detect not only whether or not all the cartridges are mounted, but also whether or not in the insufficient contact states. When the contact states are insufficient, for example, a notification that urges re-mounting of the cartridges may be displayed on the display panel 30.

Figure 14A:
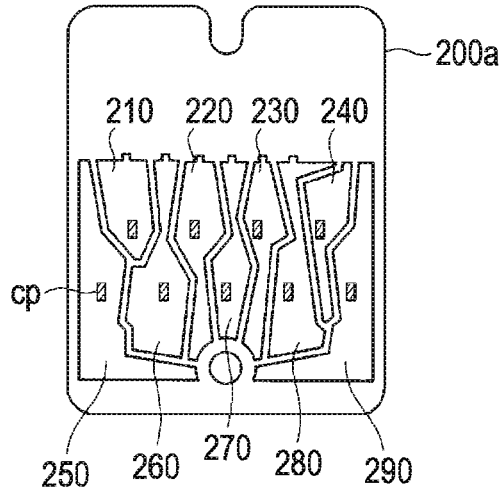
FIGS. 14A to 14C are diagrams showing the configurations of boards according to another embodiment.
Figure 14B:
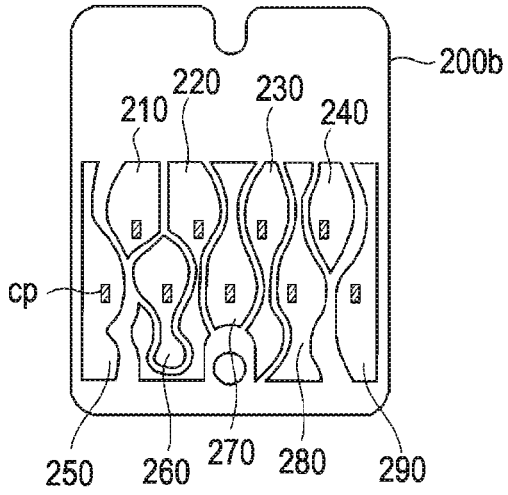
Figure 14C:
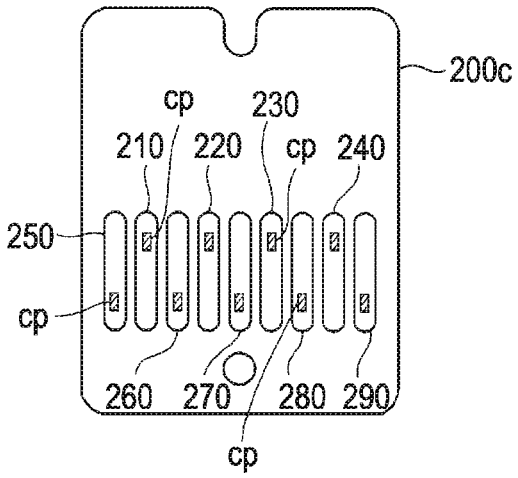

FIGS. 14A to 14C are diagrams showing the configurations of boards according to still yet another embodiment. The boards 200*a* to 200*c* are different from the board 200 shown in FIG. 3A only in the surface shapes of the terminals 210 to 290. Here, even in these boards 200*a* to 200*c*, the arrangement of the apparatus-side terminals and the contact portions cp corresponding to the respective terminals 210 to 290 is the same as that of the board 200 of FIG. 3A. As such, the surface shapes of the individual terminals can be subjected to various modifications as long as the arrangement of the contact portions cp is the same.

Figure 15:
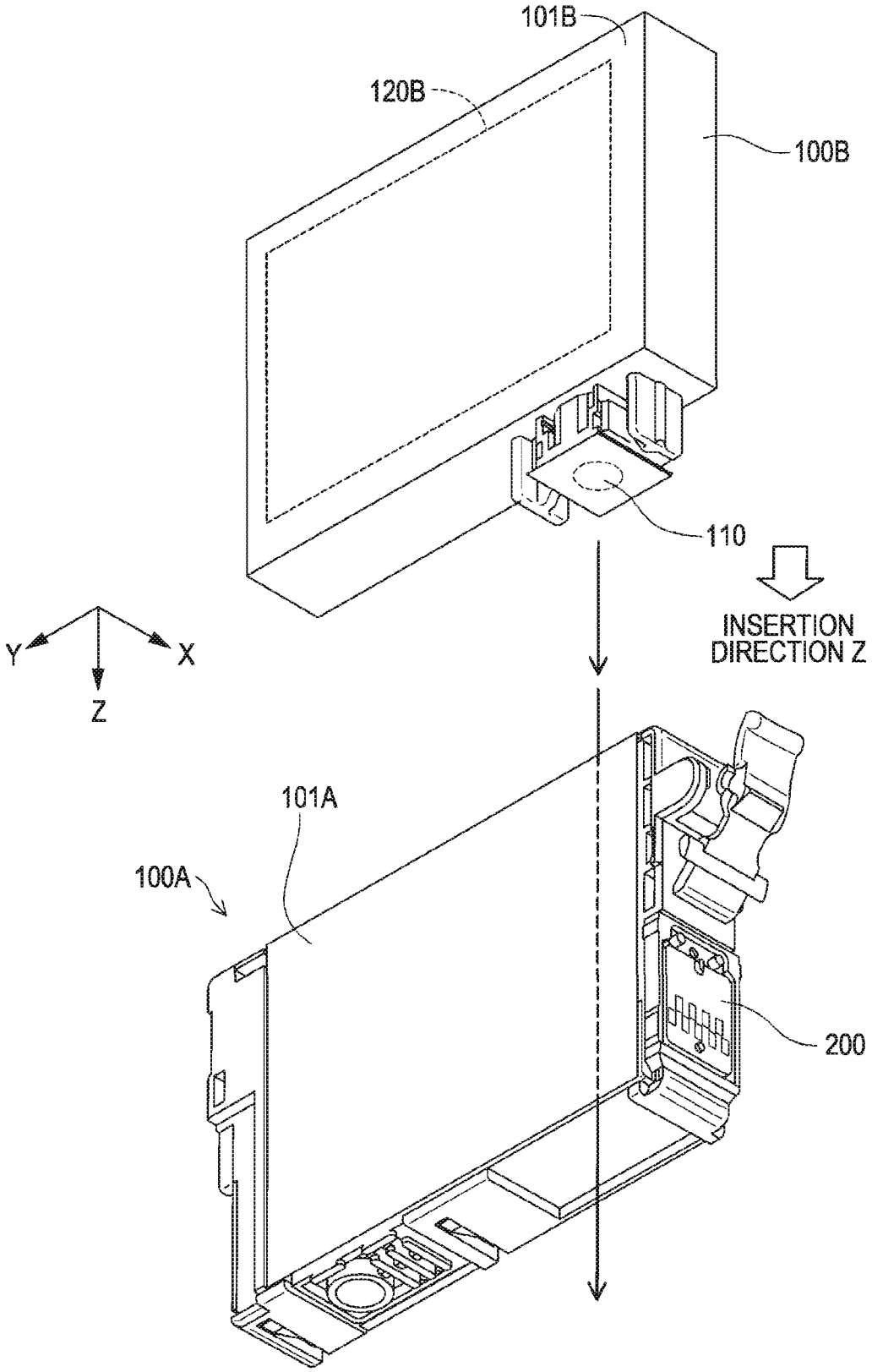
FIG. 15 is a perspective view showing the configuration of an ink cartridge according to another embodiment.
Figure 16:
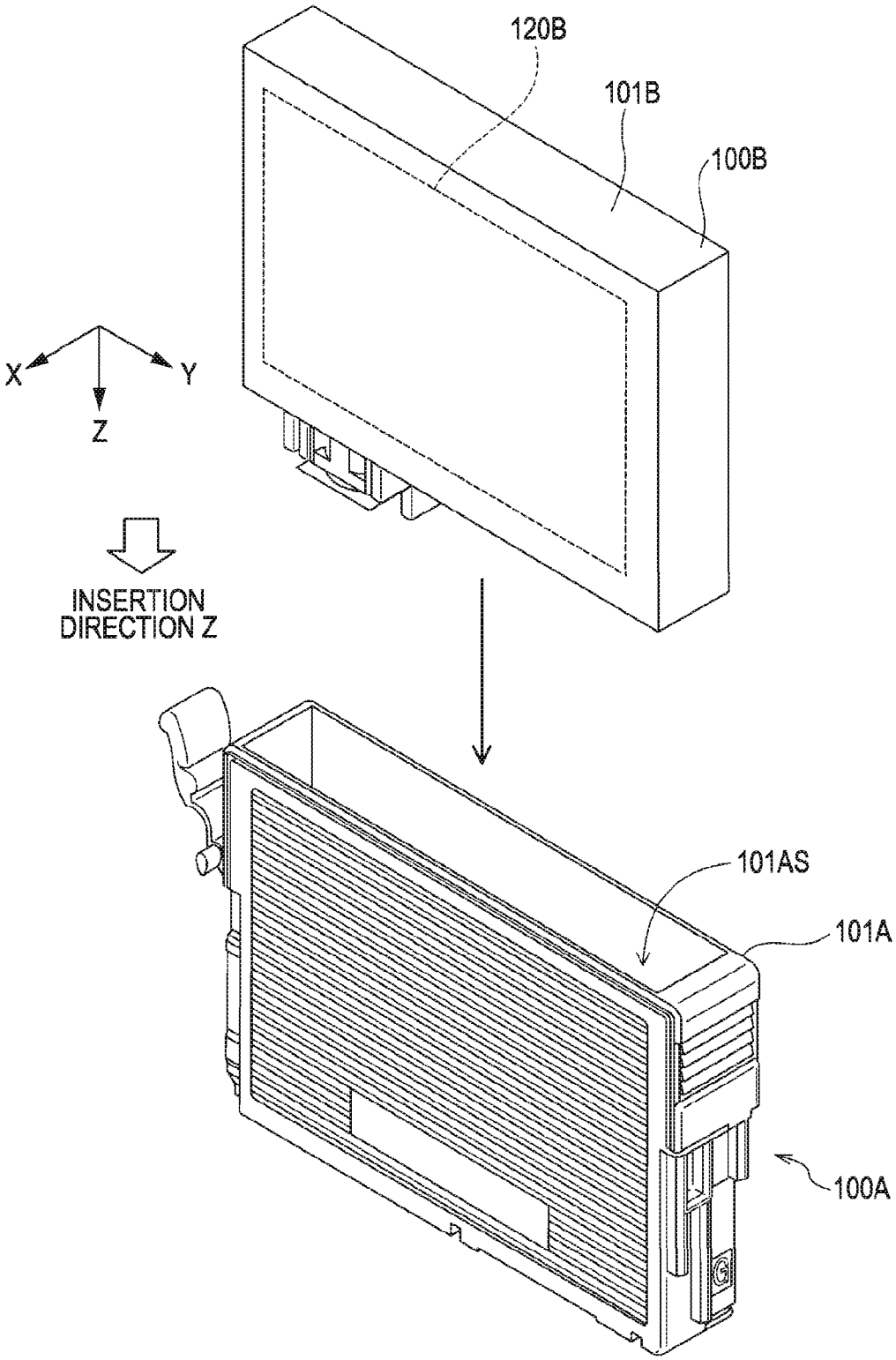
FIG. 16 is a perspective view showing the configuration of an ink cartridge according to another embodiment.

FIGS. 15 and 16 are perspective view showing the configuration of an ink cartridge according to another embodiment. The ink cartridge is divided into an ink containing portion 100B and an adaptor 100A.

The ink containing portion 100B includes a housing 101B that contains ink and an ink supply opening 110. Inside the housing 101B, an ink chamber 120B that contains the ink is formed. The ink supply opening 110 is formed at the bottom wall of the housing 101B. The ink supply opening 110 communicates with the ink chamber 120B.

The adapter 100A includes a main body 101A and a board 200. Inside the main body 101A, a space 101AS that receives the ink containing portion 100B is formed. At the upper portion of the main body 101A, an opening through the space 101AS is provided. In a state where the ink containing portion 100B is put into the space 101AS, the ink supply opening 110 protrudes from the adapter 100A through the opening 101AH. In addition, a part of the side wall of the adapter 100A may be omitted.

As such, the ink cartridge can be divided into the ink containing portion 100B (also called a "printing material container") and the adapter 100A. In this case, it is preferable that the circuit board 200 be provided on the adapter 100A side.

E. Modified Example

In addition, the invention is not limited to the above-described embodiments or embodiments, various modifications can be made without departing from the spirit and scope of the invention. For example, modifications as follows can be made.

MODIFIED EXAMPLE 1

In the embodiment, the storage device 203 and the resistive element 204 are mounted in the ink cartridge; however, a plurality of electric devices mounted in the ink cartridge is not limited thereto, and one or more arbitrary kinds of electric devices may be mounted in the ink cartridge. For example, as a sensor for ink amount detection, instead of an optical sensor, an electric device (for example, a piezoelectric element or a resistive element) may be provided in the ink cartridge. In addition, in this embodiment, both the storage device 203 and the resistive element 204 are provided in the board 200; however, the electric devices of the cartridge can be disposed on a different arbitrary member. For example, the storage device 203 may also be disposed on the housing or the adapter of the cartridge, or a different structure separate from the cartridge.

MODIFIED EXAMPLE 2

In the embodiment, the resistor for mounting detection for detecting mounting of the individual cartridge is formed by the single resistive element 204 in the n-th cartridge; however, the resistance value of the resistor for mounting detection may be realized by a plurality of resistive elements. In addition, such a single resistive element or a plurality of resistive elements may be provided on only one of the cartridge and the printing apparatus main body, or a plurality of resistive elements that constitute the resistor for mounting detection may be divided to be disposed in both the cartridge and the printing apparatus main body.

MODIFIED EXAMPLE 3

Components which have no relation to particular purposes, operations and effective from among various components described in the embodiment may be omitted. For example, the storage device 203 in the cartridge is not used for individual mounting detection of the cartridge and thus may be omitted when the individual mounting detection of the cartridge is the main purpose.

MODIFIED EXAMPLE 4

In the embodiment, the invention is applied to the ink cartridge 100; however, the invention is not limited to the ink cartridge, and can also be applied to a different printing material, for example, a printing material container which contains toner.

The entire disclosure of Japanese Patent Application No. 2010-197312, filed Sep. 3, 2010 is expressly incorporated by reference herein.

What is claimed is:

1. A printing apparatus comprising:

a holder in which a cartridge set is mounted, the cartridge set including N (N is an integer equal to or greater than 2) printing material cartridges which can be independently mounted; and a mounting detection circuit for detecting mounted states of the printing material cartridges in the holder, wherein each of the N printing material cartridges includes a storage device for storing information regarding a printing material which is contained, an electric device for mounting detection which is connected in parallel with the mounting detection circuit, a terminal for the storage device, and a terminal for the electric device, and the electric devices of the N printing material cartridges are configured so that a detection voltage detected by the mounting detection circuit becomes equal to or greater than a threshold voltage set in advance when the N printing material cartridges are all mounted in the holder;

wherein the electric devices of the N printing material cartridges are configured so that the detection voltage has a voltage value capable of uniquely identifying $2^N$ kinds of mounted states regarding the N printing material cartridges, and the mounting detection circuit determines the mounted states of the printing material cartridges in the holder on the basis of the detection voltage.

2. The printing apparatus according to claim 1, wherein the electric device of the n-th (n=1 to N) printing material cartridge from among the N printing material cartridges is a resistive element having a resistance value in a range of $2^n R(1\pm\epsilon)$ where R is a constant value and an allowable error $\epsilon$ is $1/\{4(2^{N-1}-1)\}$.

3. The printing apparatus according to claim 1, wherein, to the terminals for the electric devices of the N printing material cartridges, a voltage higher than a voltage applied to the terminals for the storage devices is supplied from the mounting detection circuit, each of the N printing material cartridges further includes a terminal for overvoltage detection provided in the vicinity of the terminal for the electric device, and the mounting detection circuit stops supplying the high voltage to the electric device when an overvoltage is detected via the terminal for overvoltage detection.

* * * * *